US008621884B2

(12) United States Patent
Stammer et al.

(10) Patent No.: US 8,621,884 B2
(45) Date of Patent: Jan. 7, 2014

(54) AC UNIT WITH ECONOMIZER AND SLIDING DAMPER ASSEMBLY

(75) Inventors: Scott Dean Stammer, Champlin, MN (US); Randal Alan Schroeder, Champlin, MN (US)

(73) Assignee: Hoffman Enclosures, Inc., Anoka, MN (US)

( * ) Notice: Subject to any disclaimer, the term of this patent is extended or adjusted under 35 U.S.C. 154(b) by 834 days.

(21) Appl. No.: 12/617,444

(22) Filed: Nov. 12, 2009

(65) Prior Publication Data

US 2010/0126208 A1 May 27, 2010

Related U.S. Application Data

(60) Provisional application No. 61/113,947, filed on Nov. 12, 2008.

(51) Int. Cl.
*F25D 17/04* (2006.01)
*F25D 17/06* (2006.01)

(52) U.S. Cl.
USPC ..... 62/409; 62/410; 62/412; 62/419; 62/427

(58) Field of Classification Search
USPC ..... 62/409–412, 419, 427
See application file for complete search history.

(56) References Cited

U.S. PATENT DOCUMENTS 2,271,487 A 1/1942 Nessell
2,308,262 A * 1/1943 Beil ..... 49/38
3,733,849 A 5/1973 Cantagallo et al.
3,995,446 A 12/1976 Eubank
4,027,498 A 6/1977 Fessler
4,147,038 A 4/1979 Hoebing et al.
4,178,770 A 12/1979 Fox
4,250,716 A 2/1981 Huffman
4,389,853 A 6/1983 Hile
4,392,510 A 7/1983 Heckmann et al.
4,397,157 A 8/1983 Keuch
4,478,056 A 10/1984 Michaels, Jr.
4,537,035 A 8/1985 Stiles
4,676,073 A 6/1987 Lawrence
4,759,196 A 7/1988 Davis
4,865,118 A 9/1989 Moland
4,882,913 A 11/1989 LaCount et al.
4,967,830 A 11/1990 Eubank et al.
4,987,952 A 1/1991 Beal et al.
5,035,281 A 7/1991 Neuenfeldt et al.
5,065,585 A 11/1991 Wylie et al.
5,069,041 A 12/1991 Thielman et al.
5,088,299 A 2/1992 Peterson
5,123,875 A 6/1992 Eubank et al.
5,249,596 A * 10/1993 Hickenlooper et al. ..... 137/334
5,301,744 A 4/1994 Derks
5,324,229 A 6/1994 Weisbecker
(Continued)

*Primary Examiner* — Frantz Jules
*Assistant Examiner* — Joseph Trpisovsky
(74) *Attorney, Agent, or Firm* — Quarles & Brady LLP

(57) ABSTRACT

Embodiments of the invention provide an air conditioning unit that includes an intake vent, an exhaust vent, a return vent, a supply vent, and an economizer assembly including a sliding damper and a partition. The partition includes an opening through which air can flow from the return vent to the supply vent during a mechanical cooling mode. The sliding damper includes a vertical panel capable of moving vertically to close the intake vent and the exhaust vent during the mechanical cooling mode and an angled panel capable of closing the opening in the partition in order to enter an economizer mode.

21 Claims, 6 Drawing Sheets

(56) References Cited

U.S. PATENT DOCUMENTS

| | | | | |
|---|---|---|---|---|
| 5,447,037 | A | 9/1995 | Bishop et al. | |
| 5,485,878 | A | 1/1996 | Derks | |
| 5,548,970 | A | 8/1996 | Cunningham, Jr. et al. | |
| 5,616,169 | A | 4/1997 | de Ruiter et al. | |
| 5,720,182 | A | 2/1998 | Imre | |
| 5,772,710 | A | 6/1998 | Bauer et al. | |
| 5,801,632 | A | 9/1998 | Opal | |
| 6,038,879 | A | 3/2000 | Turcotte et al. | |
| 6,161,764 | A | 12/2000 | Jatnieks | |
| RE37,245 | E * | 6/2001 | Scholten et al. | 236/49.3 |
| 6,299,526 | B1 | 10/2001 | Cowan et al. | |
| 6,467,696 | B2 | 10/2002 | Riley et al. | |
| 6,488,081 | B2 | 12/2002 | Rayburn et al. | |
| 6,549,406 | B1 | 4/2003 | Olesiewicz et al. | |
| 6,634,422 | B2 | 10/2003 | Rayburn et al. | |
| 6,644,049 | B2 | 11/2003 | Alford | |
| 6,817,206 | B2 | 11/2004 | Shahbaz | |
| 6,885,554 | B1 | 4/2005 | Reeck et al. | |
| 6,990,817 | B1 | 1/2006 | Bhatia | |
| 6,997,006 | B2 | 2/2006 | Kameyama et al. | |
| 7,104,753 | B2 | 9/2006 | Eubank et al. | |
| 2001/0052240 | A1 * | 12/2001 | Kim et al. | 62/409 |
| 2002/0036238 | A1 | 3/2002 | Riley et al. | |
| 2002/0063476 | A1 | 5/2002 | Rolls et al. | |
| 2002/0166811 | A1 * | 11/2002 | Walker et al. | 210/455 |
| 2005/0063156 | A1 | 3/2005 | Olesiewicz et al. | |
| 2005/0207882 | A1 | 9/2005 | Yoshida | |
| 2005/0284162 | A1 | 12/2005 | Grabon et al. | |
| 2006/0021375 | A1 * | 2/2006 | Wetzel et al. | 62/419 |
| 2008/0016897 | A1 * | 1/2008 | Yasutomi et al. | 62/298 |

* cited by examiner

AC UNIT WITH ECONOMIZER AND SLIDING DAMPER ASSEMBLY

RELATED APPLICATIONS

This application claims priority under 35 U.S.C. §119 to U.S. Provisional Patent Application No. 61/113,947 filed on Nov. 12, 2008, the entire contents of which is incorporated herein by reference.

BACKGROUND

Air conditioning (AC) systems for electrical enclosures can include an economizer assembly to allow circulation of fresh, outdoor air into the enclosures. This can maintain the quality of the indoor air as well as save energy by reducing the work done by a mechanical cooling system.

While current AC systems for larger-sized electrical enclosures use economizers, they require fairly large additional attachments or custom housings to incorporate the economizer assemblies. The increased size of the housing or complicated construction of the additions can greatly increase costs of these AC systems. Smaller AC systems often do not include an economizer assembly to prevent increased costs of requiring such a large and/or complex footprint to air condition a small space.

In addition, conventional economizer assemblies use rotating damper assemblies to control multiple vent or port openings. The multiple damper assemblies require multiple motor control devices, increasing initial costs for the AC system, as well as maintenance costs for the control devices. Also, the rotating damper blades often do not sufficiently seal the vent openings, creating air leakage issues for the AC system.

SUMMARY

Some embodiments of the invention provide an air conditioning unit that selectively cools an enclosure with ambient air from an ambient environment. The air conditioning unit includes an intake vent capable of receiving cool ambient air, an exhaust vent capable of discharging warm air to the ambient environment, a return vent that receives warm air from the enclosure, a supply vent that provides cool air to the enclosure, and an economizer assembly that includes a sliding damper and a partition. The partition includes an opening through which air can flow from the return vent to the supply vent during a mechanical cooling mode. The sliding damper includes a vertical panel and an angled panel. The vertical panel is capable of moving vertically to close the intake vent and the exhaust vent during the mechanical cooling mode and the angled panel is capable of closing the opening in the partition in order to enter an economizer mode in which cool ambient air flows from the intake vent to the supply vent and warm air flows from the return vent to the exhaust vent.

DETAILED DESCRIPTION

Figure 1:
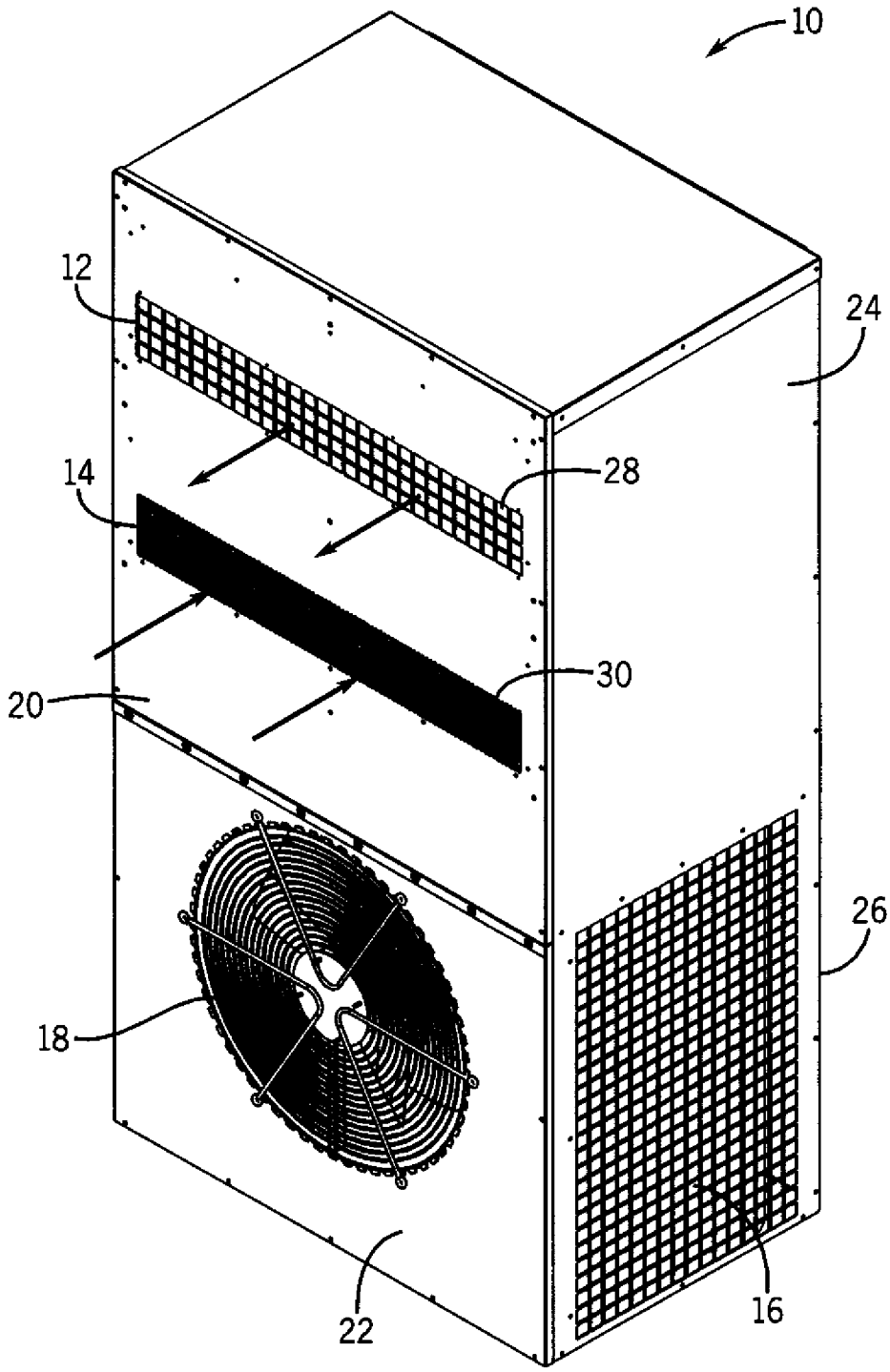
FIG. 1 is a perspective view of an AC unit according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 illustrates an AC unit 10 according to one embodiment of the invention. The AC unit 10 can be a side-mounted unit to a small building or enclosure that holds electronics for cellular phone towers or similar applications. In other embodiments, the AC unit 10 can be used for conditioning air in other spaces, such as buildings, houses, or enclosures.

As shown in FIG. 1, the AC unit 10 can include an exhaust vent 12, an intake vent 14, a port 16, a condenser fan 18, a top front panel 20, a bottom front panel 22, a top portion 24, and a bottom portion 26. The exhaust vent 12 can permit the release of exhaust air from the AC unit 10 to the outside surroundings (i.e., the ambient environment). The intake vent 14 can permit the intake of cool, outdoor air when the AC unit 10 is in an economizer mode. The top front panel 20 and bottom front panel 22 can separate the top portion 24 and the bottom portion 26, respectively, of the AC unit 10 from the ambient environment.

Figure 2:
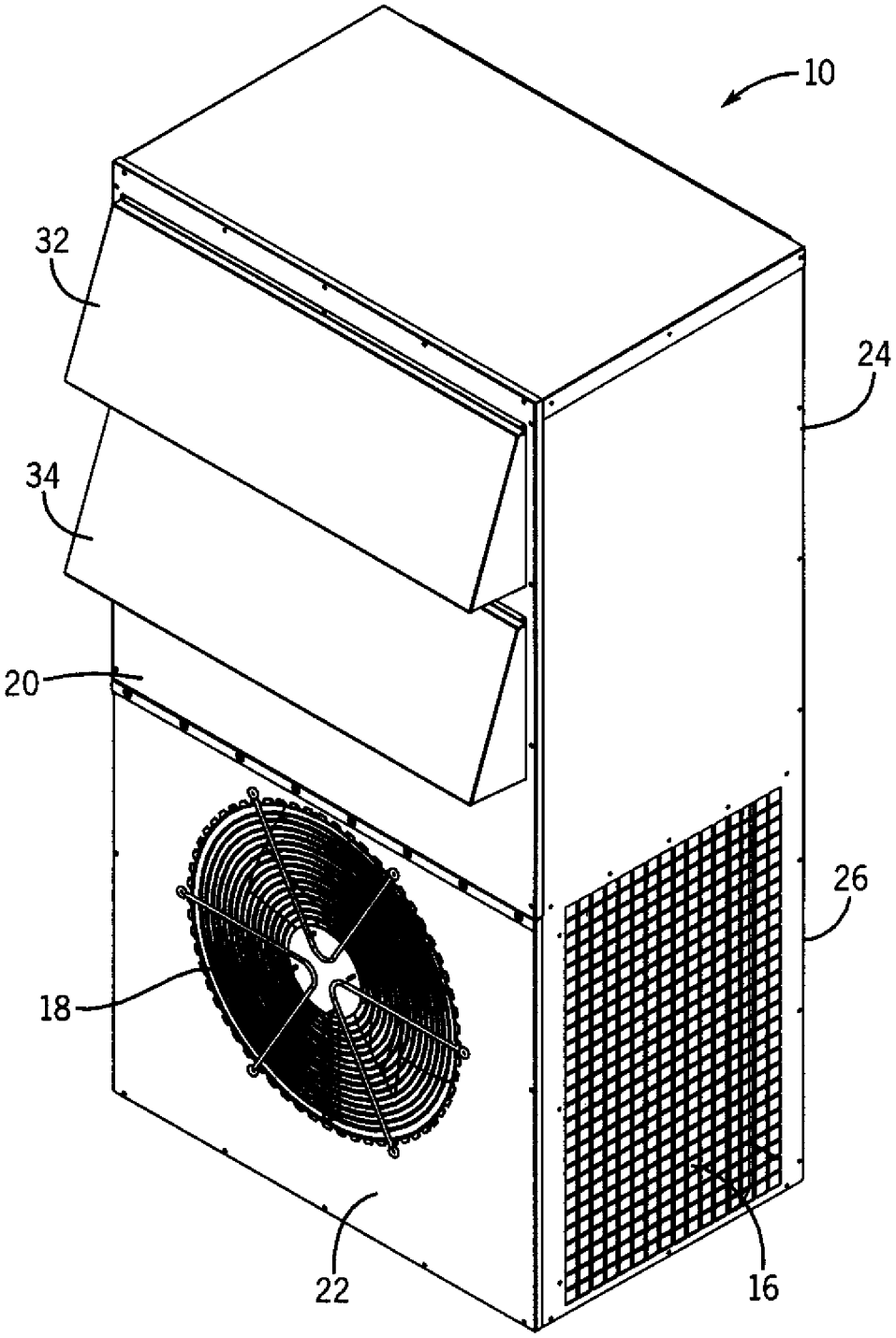
FIG. 2 is another perspective view of the AC unit of FIG. 1.

The exhaust vent 12 and the intake vent 14 can each include a grill 28, 30. In some embodiments, the grills 28, 30 can be punch patterns made in the top front panel 20. The apertures of the grills 28 and 30 can be sized so they do not impede the exchange of air, but still protect the vents 12 and 14 from small animals or debris. The direction of air flow through the vents 12 and 14 is illustrated by arrows in FIG. 1. As shown in FIG. 2, the AC unit 10 can also include vent hoods 32 and 34 over the exhaust vent 12 and the intake vent 14 to direct airflow and prevent rain or debris from contacting the grills 28, 30.

Figure 3:
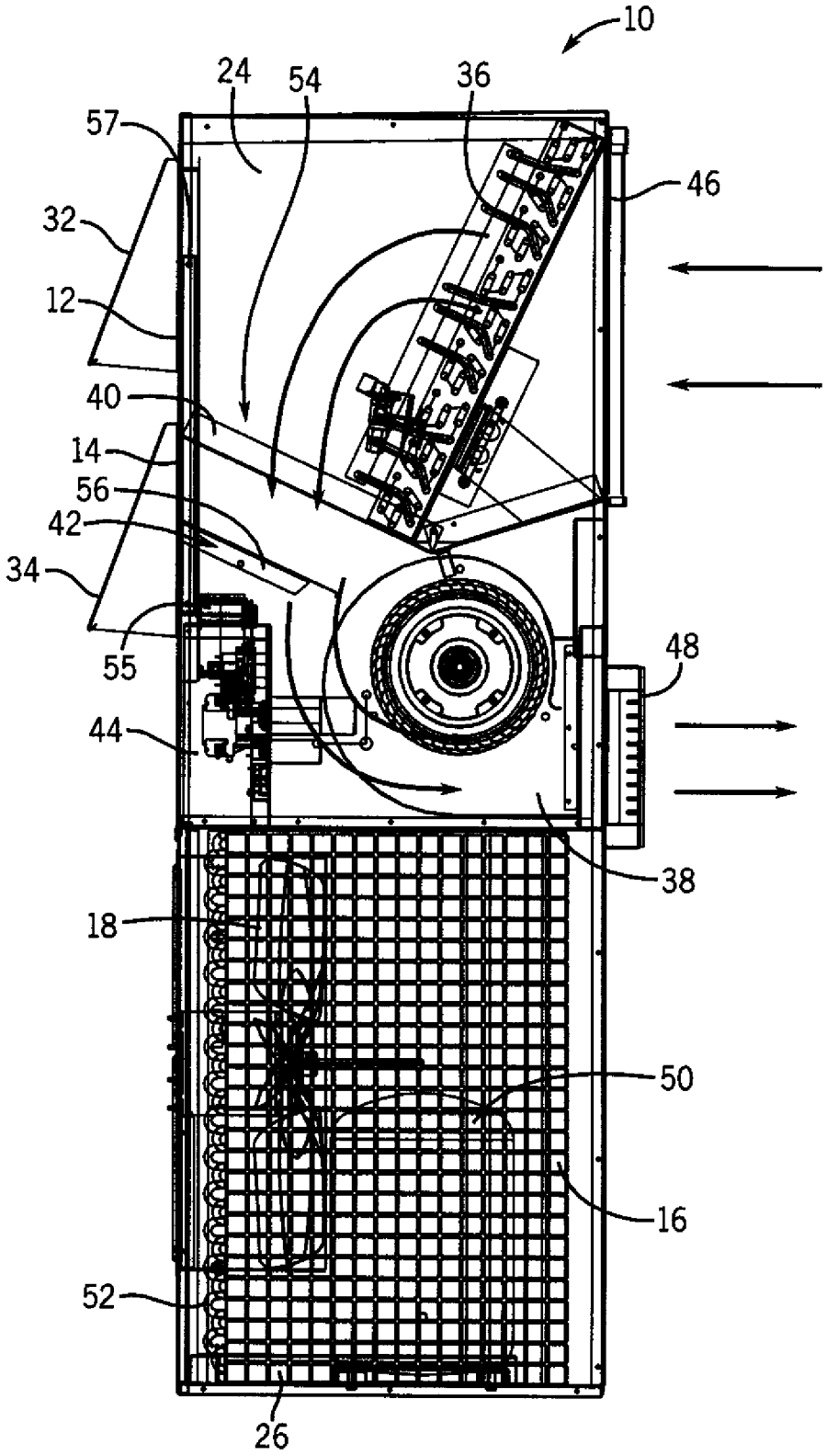
FIG. 3 is a side cross-sectional view of the AC unit of FIG. 1 while in a mechanical cooling mode.

As shown in FIG. 3, the top portion 24 can include an evaporator 36, a supply fan 38, a partition 40, a sliding damper 42, and a control system 44. The top portion 42 can be open to the inside of the enclosure through a return vent 46 and a supply vent 48. The bottom portion 26 can be closed off from the inside of the enclosure and can include a compressor 50, a condenser 52 and the condenser fan 18. The condenser fan 18 can pull outside air through the port 16 and across the condenser coils 52 to cool and condense heated refrigerant in a refrigeration cycle. In some embodiments, the only components that transfer between the top portion 24 and bottom portion 26 can be piping containing refrigerant that circulates through the refrigeration cycle. The top portion 24 and bottom portion 26 can also be referred to as the indoor and outdoor sections, respectively.

Figure 4:
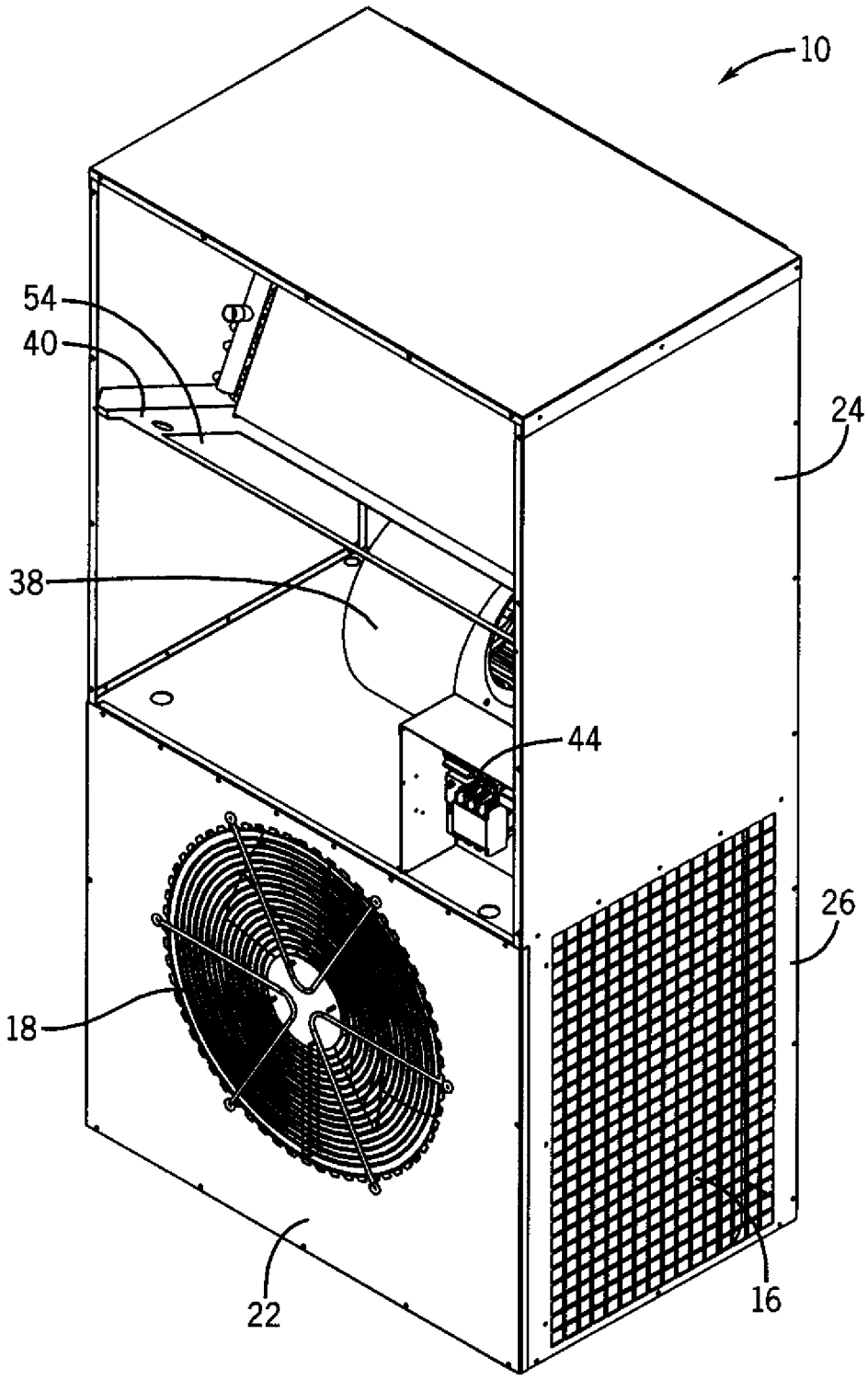
FIG. 4 is an internal perspective view of a top portion of the AC unit of FIG. 1.

The partition 40 in the top portion 24 can partially separate the return vent 46 and the exhaust vent 12 from the intake vent 14 and the supply vent 48. As shown in FIG. 4, the partition 40 can also include an opening 54. The control system 44 can control the sliding damper 42 via a damper motor 55 (as shown in FIG. 3) to cover or uncover the opening 54. In some embodiments, the sliding damper can include an angled panel 56 and a vertical panel 57. The angled panel 56 can be coupled to the vertical panel 57 at an angle between about 45 degrees and about 90 degrees in some embodiments.

When the sliding damper 42 is not covering the opening 54, as shown in FIG. 3, the AC unit 10 can be in a mechanical cooling mode. When the sliding damper 42 is covering the opening 54, as shown in FIG. 5, the partition 40 and the angled panel 56 can completely separate the return vent 46 and the exhaust vent 12 from the intake vent 14 and the supply vent 48, and the AC unit 10 can be in an economizer cooling mode.

In the mechanical cooling mode, as shown in FIG. 3, the sliding damper 42 can be slid downward so that the vertical panel 57 can cover the intake vent 14 as well as the exhaust vent 12. With the sliding damper 42 in this position, the supply fan 38 can pull air through the opening 54 and force the air back into the enclosure, as indicated by arrows in FIG. 3. More specifically, warm, return air can flow through the return vent 46 and across the evaporator coils 36, causing the air to be cooled. The cooled return air can then be pulled through the opening 54 and through the supply vent 48 by the supply fan 38.

The mechanical cooling system can include the elements necessary for a refrigeration cycle, including, but not limited to, the condenser 52, the compressor 50, the evaporator 36, an expansion device (not shown), connective piping, and a liquid to be cycled through the system (e.g., a refrigerant). The refrigerant, at low pressure and in liquid form, cycles through the evaporator coils 36 absorbing heat from passing return air, resulting in the warm return air being cooled and the refrigerant being heated to a vapor at low pressure. The low-pressure, vapor refrigerant reaches the compressor 50, which increases the pressure of the vapor. The high-pressure, high-temperature vapor travels through the condenser coils 52 and is cooled by outside air flowing across the coils, causing the vapor to condense. The cooled, high-pressure liquid reaches the expansion device, which reduces the pressure, continuing to cool the liquid. Finally, the cool, low-pressure liquid again reaches the evaporator coils 36 to complete the cycle and cool the return air. Modifications and alterations of the refrigeration cycle can be made in some embodiments.

Figure 5:
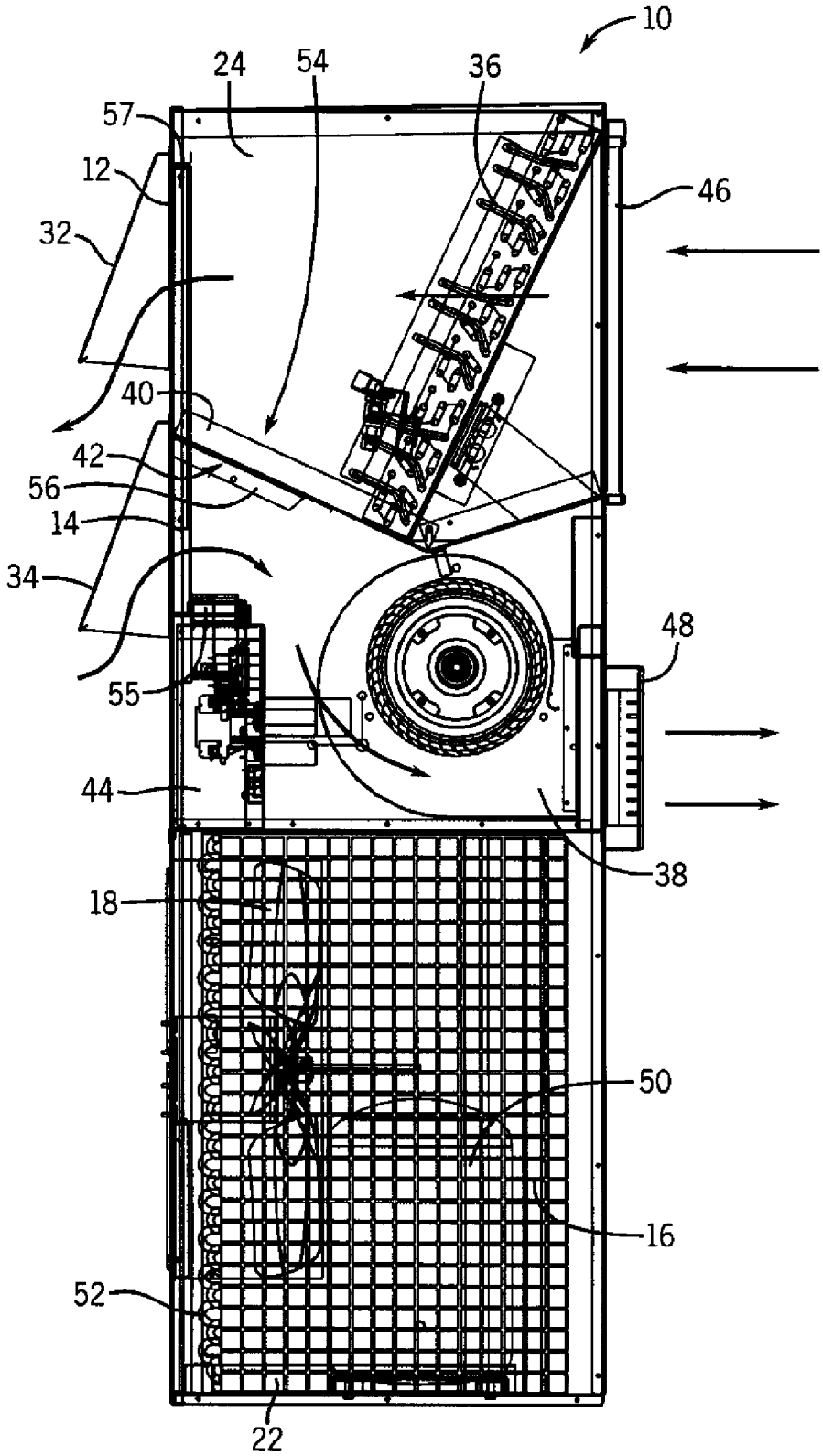
FIG. 5 is a side cross-sectional view of the AC unit of FIG. 1 while in an economizer cooling mode.

In the economizer cooling mode, as shown in FIG. 5, the sliding damper 42 can be slid upward to cover the opening 54 and uncover both the exhaust vent 12 and the intake vent 14. With the sliding damper 42 in this position, the return air can be released through the exhaust vent 12 and ambient supply air can be pulled from the outside surroundings through the intake vent 14, as indicated by arrows in FIG. 5. In some embodiments, a filter (not shown) can be positioned in front of the grill 30 to filter incoming ambient air from dirt and/or debris. In one embodiment, the filter can be a hydrophobic filter to filter incoming ambient air from water as well as dirt and/or debris.

In some embodiments, the partition 40 and the sliding damper 42 can create an economizer assembly for the AC unit 10. In other embodiments, other components capable of allowing outside air to be supplied into the enclosure can be included as an economizer assembly in the AC unit 10.

Mechanical cooling of the return air is generally unnecessary in the economizer cooling mode because all return air is exhausted outside. As a result, refrigerant does not need to be cycled through piping and the compressor 50 and the condenser fan 18 can be turned off to save energy. In some embodiments, economizer cooling can either be 100% on or 100% off, meaning only economizer cooling or only mechanical cooling can be operating at any given time. In other embodiments, the control system 44 can move the sliding damper 42 to one of multiple positions to achieve a mixture of economizer cooling and mechanical cooling modes. For example, the sliding damper 42 can be positioned to allow 50% outside air and 50% return air to be mixed and supplied to the enclosure. In this mode, the position of the sliding damper 42 can provide openings of appropriate size for the intake vent 14, the exhaust vent 12, and the opening 54. From this intermediate position, the sliding damper 42 can be slid up or down to allow suitable proportions of outdoor air and return air to be supplied to the enclosure.

In some embodiments, the AC unit 10 can include a dry bulb economizer assembly, in which the control system 44 controls the economizer assembly based on sensed temperatures. In other embodiments, the AC unit 10 can include an enthalpy economizer assembly, in which the economizer cooling mode is controlled based on air enthalpy, in addition to temperature. For example, outside air enthalpy can be measured to determine if the economizer cooling mode is sufficient for ventilating the enclosure. This can be accomplished using an outside air enthalpy sensor and/or an inside air enthalpy sensor, as well as an outside air temperature sensor, an inside air temperature sensor, an outside humidity sensor, and/or an inside humidity sensor. The outside air enthalpy and temperature sensors can be placed outside the AC unit 10 to retrieve an accurate representation of the outside air enthalpy and temperature. For example, the outside sensors can be placed a substantial distance from the exhaust vent 12, because sensing the enthalpy of air from the exhaust vent would not give an accurate representation of the outside air. Inside air enthalpy and temperature sensors can be placed either inside the enclosure near the return vent 46 or within the AC unit 10 directly in line with return air in order to retrieve an accurate representation of inside air enthalpy and temperature. The control system 44 can determine the outside and/or inside air enthalpies, as well as compare the outside and inside air temperatures to determine whether outdoor air can be used to cool the enclosure rather than mechanical cooling. The control system 44 can then adjust the position of the sliding damper 42 accordingly.

Figure 6:
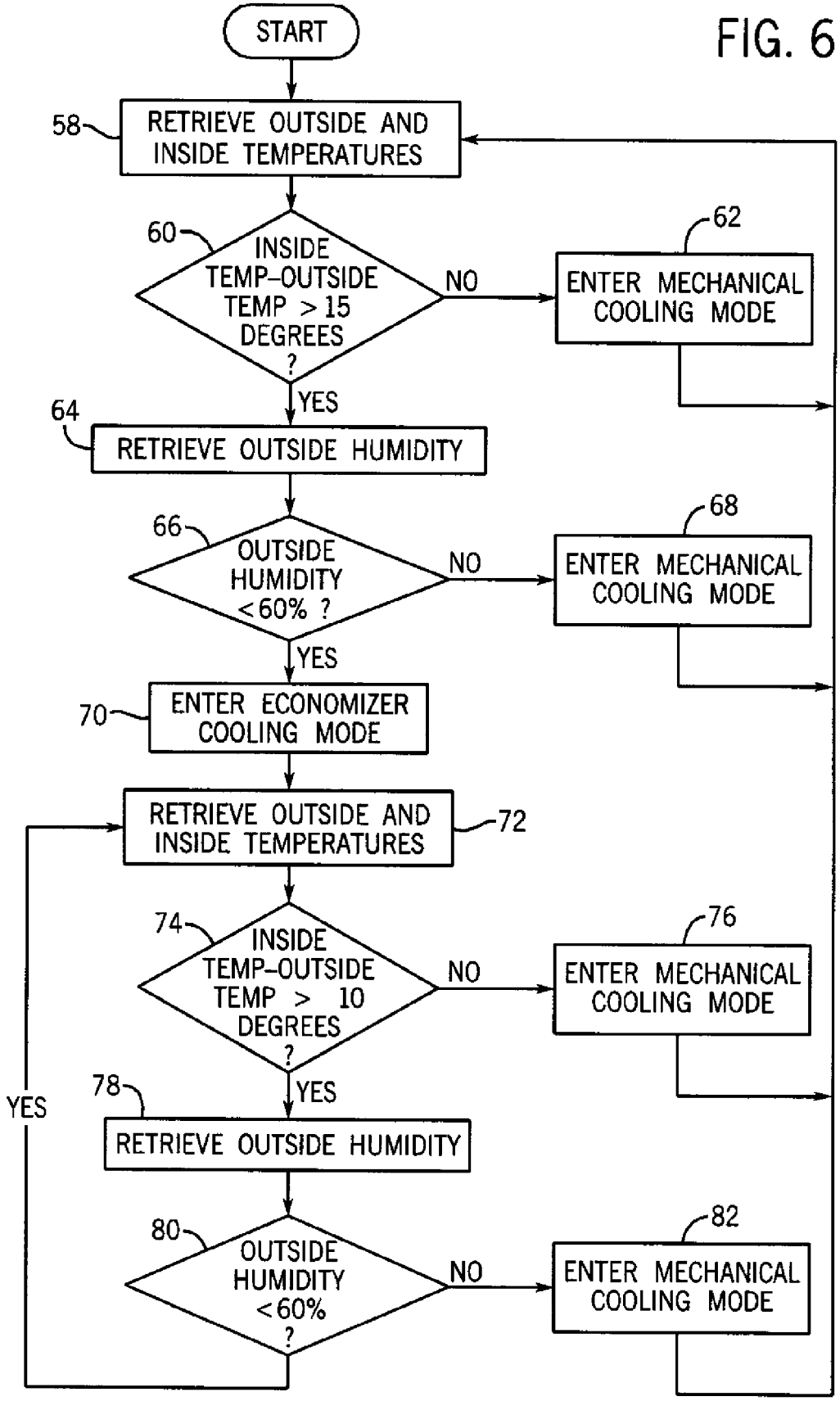
FIG. 6 is a flow chart illustrating operation of a control system of the AC unit of FIGS. 1-5.

In one embodiment, inputs to the control system 44 can include inside air temperature, outside air temperature, and outside humidity, as shown in the flow chart of FIG. 6. The control system 44 can first determine (at step 58) outside and inside temperatures (e.g., from the temperature sensors). The control system 44 can then compare (at step 60) the inside and outside temperatures. If the inside temperature is less than about 15 degrees Fahrenheit warmer than the outside temperature, the control system 44 can proceed to step 62 and enter or continue in the mechanical cooling mode. The control system 44 can continue in the mechanical cooling mode until the inside temperature is about 15 degrees Fahrenheit warmer than the outside temperature, as determined at step 60. The control system 44 can then proceed to step 64. The control system 44 can retrieve (at step 64) the outside humidity (e.g., from the outside humidity sensor). If the outside humidity is greater than about 60%, as determined at step 66, the control system 44 can proceed to step 68 and enter or continue in the mechanical cooling mode. If not, the control system 44 can proceed to step 70 and enter the economizer cooling mode.

While in the economizer cooling mode, the control system 44 can again retrieve (at step 72) the outside and inside temperatures. The control system 44 can again compare (at step 74) the inside and outside temperatures. If the inside temperature is less than about 10 degrees Fahrenheit warmer the outside temperature, the control system 44 can proceed to step 76 and enter the mechanical cooling mode. If the inside temperature is about 10 degrees Fahrenheit warmer than the outside temperature, the control system 44 can proceed to step 78. At step 78, the control system 44 can again determine the outside humidity. If the outside humidity is greater than about 60%, as determined at step 80, the control system 44 can proceed to step 82 and enter the mechanical cooling mode. If not, the control system 44 can continue in the economizer cooling mode and return to step 72.

In some embodiments, if the outside humidity exceeds about 60%, the control system 44 can operate the AC unit 10 in the mechanical cooling mode regardless of the measured temperature differences. Also, other temperature and humidity thresholds or limits can be used in some embodiments. Outputs from the control system 44 can include signals to control the damper motor (to change between the mechanical cooling mode and the economizer cooling mode, or vice versa) and signals to control the fan motors (while in the mechanical cooling mode, as described below). In some embodiments, the control system 44 can monitor the recovery rate of the inside temperature in the enclosure. If the AC unit 10 in the economizer cooling mode has not sufficiently cooled the enclosure at a desired rate, the control system 44 can switch to the mechanical cooling mode or some other mixture of economizer cooling and mechanical cooling can be implemented.

The control system 44 can also control fan motors for the condenser fan 18 and the supply fan 38. The AC unit 10 can be used to cool electrical enclosures (where the inside of the enclosure is a dry, clean environment). Positioning the control system 44, the fan motors, and the damper motor 55 in the top portion 24 as shown in FIG. 4, rather than in the bottom portion 26 where they would constantly be in contact with humid, ambient air, can reduce the cost and/or increase the life of the motors. In addition, if the enclosure is sufficiently cool, mechanical cooling can be slowed, because less refrigerant needs to be circulated through the refrigeration cycle. The control system 44 can vary the speed of the fan motors controlling the fans 18, 38. This can also reduce the noise emitted by the fans 18, 38. In some embodiments, the control system 44 can include a proportional-integral-derivative (PID) controller to control the fan motors and the damper motor 55 based on temperatures and/or enthalpies.

As shown in FIGS. 1-5, the AC unit 10 can be compact, while still utilizing energy-conserving economizer functionality. For example, unlike conventional AC units with economizers, such as units with rotating dampers, the economizer assembly can fit into a standard AC unit foot print. The single sliding damper 42 can control the opening 54, as well as the exhaust vent 12 and the intake vent 14, in order to control return air, outdoor air, and exhaust air without adding to the overall height and footprint of the AC unit 10. In addition, since the sliding damper 42 does not take up excess space, the economizer assembly can be retrofitted into existing AC units.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. An air conditioning unit including an evaporator, a condenser, a compressor, and a supply fan that selectively cools an enclosure with ambient air from an ambient environment, the air conditioning unit comprising:

an intake vent capable of receiving cool ambient air;

an exhaust vent capable of discharging warm air to the ambient environment;

a return vent that receives warm air from the enclosure;

a supply vent that provides cool air to the enclosure; and an economizer assembly including a sliding damper and a partition, the partition including an opening through which air can flow from the return vent to the supply vent across the evaporator during a mechanical cooling mode;

the sliding damper including a vertical panel and an angled panel, the vertical panel capable of moving vertically to close the intake vent and the exhaust vent during the mechanical cooling mode, the angled panel capable of closing the opening in the partition in order to enter an economizer mode in which the supply fan pulls cool ambient air from the intake vent to flow to the supply vent and warm air flows from the return vent to the exhaust vent.

2. The air conditioning unit of claim 1 and further comprising a control system including a damper motor to change the vertical position of the sliding damper.

3. The air conditioning unit of claim 2 wherein the control system includes at least one of a temperature sensor, an enthalpy sensor, and a humidity sensor.

4. The air conditioning unit of claim 2 wherein the control system can change the vertical position of the sliding damper in order to change between the mechanical cooling mode and the economizer mode based on at least one of temperature, enthalpy, and humidity.

5. The air conditioning unit of claim 2 wherein the control system can include an inside temperature sensor and an outside temperature sensor.

6. The air conditioning unit of claim 2 wherein the control system can include an inside enthalpy sensor and an outside enthalpy sensor.

7. The air conditioning unit of claim 2 wherein the control system can include an inside humidity sensor and an outside humidity sensor.

8. The air conditioning unit of claim 2 wherein the control system uses proportional-integral-derivative feedback to control at least one of a fan motor and the damper motor.

9. The air conditioning unit of claim 1 and further comprising a condenser fan, wherein the compressor and the condenser fan only operate during the mechanical cooling mode.

10. The air conditioning unit of claim 1 wherein the angled panel is coupled to the vertical panel at an angle of between about 45 degrees and about 90 degrees.

11. The air conditioning unit of claim 1 and further comprising a filter positioned adjacent to the intake vent in order to substantially prevent water, dirt, and debris from entering the air conditioning unit and the enclosure.

12. The air conditioning unit of claim 11 wherein the filter is hydrophobic.

13. The air conditioning unit of claim 1 wherein the air conditioning unit is side-mounted to the enclosure.

14. The air conditioning unit of claim 1 wherein the air conditioning unit can operate according to a mixed economizer and mechanical cooling mode.

15. The air conditioning unit of claim 14 wherein the sliding damper can be positioned in an intermediate vertical position in order to allow some cool ambient air to enter the intake vent and some warm air to discharge out the exhaust vent.

16. The air conditioning unit of claim 1 wherein the air conditioning unit can operate in the mechanical cooling mode when an inside temperature becomes less than about 10 degrees warmer than an outside temperature.

17. The air conditioning unit of claim 1 wherein the air conditioning unit can operate in the economizer cooling mode when an outside temperature is about 15 degrees less than an inside temperature.

18. The air conditioning unit of claim 1 wherein the air conditioning unit can operate in the mechanical cooling mode when an outside humidity is greater than about 60 percent.

19. The air conditioning unit of claim 17 wherein the air conditioning unit can operate in the mechanical cooling mode when an outside humidity is greater than about 60 percent regardless of a difference between an inside temperature and an outside temperature.

20. The air conditioning unit of claim 1 wherein the sliding damper moves vertically downward in order to cover the intake vent and the exhaust vent for the mechanical cooling mode.

21. The air conditioning unit of claim 1 and further comprising a control system with a damper motor and at least one fan motor positioned in a top portion of the air conditioning unit in order to be substantially isolated from humid, ambient air.

* * * * *